US006594917B2

(12) United States Patent
Ricco'et al.

(10) Patent No.: US 6,594,917 B2
(45) Date of Patent: Jul. 22, 2003

(54) SHOE WITH AN ACTIVE AIR-CONDITIONING DEVICE

(76) Inventors: Bruno Ricco', Via Sant'Apollonia, 2, 40126 Bologna (IT); Domenico Valori, Galleria del Commercio, 5, 62100 Macerata (IT)

( * ) Notice: Subject to any disclaimer, the term of this patent is extended or adjusted under 35 U.S.C. 154(b) by 0 days.

(21) Appl. No.: 09/864,435

(22) Filed: May 24, 2001

(65) Prior Publication Data

US 2002/0050074 A1 May 2, 2002

Related U.S. Application Data

(63) Continuation of application No. PCT/IT99/00384, filed on Nov. 24, 1999.

(30) Foreign Application Priority Data

Nov. 24, 1998 (IT) ..... BO98A0656

(51) Int. Cl.[7] ..... A43B 7/06; F25D 9/00

(52) U.S. Cl. ..... 36/3 R; 36/3 A; 36/3 B; 62/401

(58) Field of Search ..... 36/3 A, 3 B, 3 R, 36/2.6; 62/401, 259.3

(56) References Cited

U.S. PATENT DOCUMENTS

| | | | | | |
|---|---|---|---|---|---|
| 1,649,236 | A | * | 11/1927 | Jurcsak | 36/3 R |
| 2,474,815 | A | * | 7/1949 | Brahm | 36/3 B |
| 4,584,838 | A | * | 4/1986 | AbuJudom, II | 62/401 |
| 4,736,530 | A | | 4/1988 | Lakic et al. | |
| 4,823,482 | A | * | 4/1989 | Lakic | 36/2.6 |
| 4,905,475 | A | * | 3/1990 | Tuomi | 62/259.3 |
| 5,375,430 | A | * | 12/1994 | Siegel | 62/259.3 |
| 5,442,934 | A | * | 8/1995 | Wolflick | 62/401 |
| 5,606,806 | A | | 3/1997 | O'Dwyer | |
| 5,642,629 | A | * | 7/1997 | Ohman | 62/401 |
| 6,085,444 | A | * | 7/2000 | Cho | 36/3 B |

FOREIGN PATENT DOCUMENTS

| | | |
|---|---|---|
| FR | 2 469 886 | 5/1981 |
| FR | 2 777 637 | 10/1999 |
| WO | WO 93/07773 | 4/1993 |

* cited by examiner

*Primary Examiner*—Anthony D. Stashick
(74) *Attorney, Agent, or Firm*—Chapman and Cutler

(57) ABSTRACT

A shoe (1) having an active air-conditioning device (2) for maintaining the temperature inside the shoe (1) at a value selectively above or below the temperature of the outside environment. The air-conditioning device(20) is integrated in the sole (3) of the shoe (1), and comprises a main heat exchanger (4) for exchanging heat with the inside of the shoe (1), and air compressing device (5) for feeding a pressurized air stream to the main heat exchanger (4), an auxiliary heat exchanger (10) located between the air compressing device (5) and the main heat exchanger (4) to reduce the temperature of the pressurized air stream, an expansion valve (11) located immediately downstream from the auxiliary heat exchanger (10) to rapidly expand and so cool the pressurized air stream, and a bypass conduit (12) with a relative on-off valve (13), for connecting the main heat exchanger (4) directly to the air compressing device.

17 Claims, 2 Drawing Sheets

SHOE WITH AN ACTIVE AIR-CONDITIONING DEVICE

This is a continuation of an International Application PCT/IT99/00384 filed Nov. 24, 1999.

TECHNICAL FIELD

The present invention relates to a shoe with an active air-conditioning device.

In the following description, the tern "shoe" is used to indicate, indifferently, shoes, boots, hiking boots, ski boots, army boots, and any other type of footwear covering a wide range of uses.

BACKGROUND ART

As is known, numerous types of shoes are currently marketed featuring a built-in ventilation device for circulating a stream of air inside the shoe to air the foot.

Currently used ventilation devices are normally built into the sole of the shoe, and normally comprise: a pump unit activated by the wearer as he or she walks; and two connecting conduits for connecting the pump unit to the inside of the shoe and to the outside environment respectively. The pump unit is normally defined by a variable-volume pumping chamber formed inside the heel of the sole, which is obviously made of rubber, and by two one-way valves located at the inlets of the two connecting conduits. The one-way valves may be so oriented as to direct a stream of air inwards or outwards of the shoe alongside cyclic variations in the volume of the pumping chamber induced by the alternating weight exerted on the sole.

A major drawback of ventilation devices of the above type is that of simply circulating air inside the shoe to maintain an acceptable level of humidity, but with substantially no change in the temperature of the air inside the shoe.

DISCLOSURE OF INVENTION

It is an object of the present invention to provide an air-conditioning device designed to eliminate the aforementioned drawbacks.

According to the present invention, there is provided a shoe, characterized by comprising an air-conditioning device for maintaining the temperature inside the shoe at a value selectively above or below the temperature of the outside environment.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
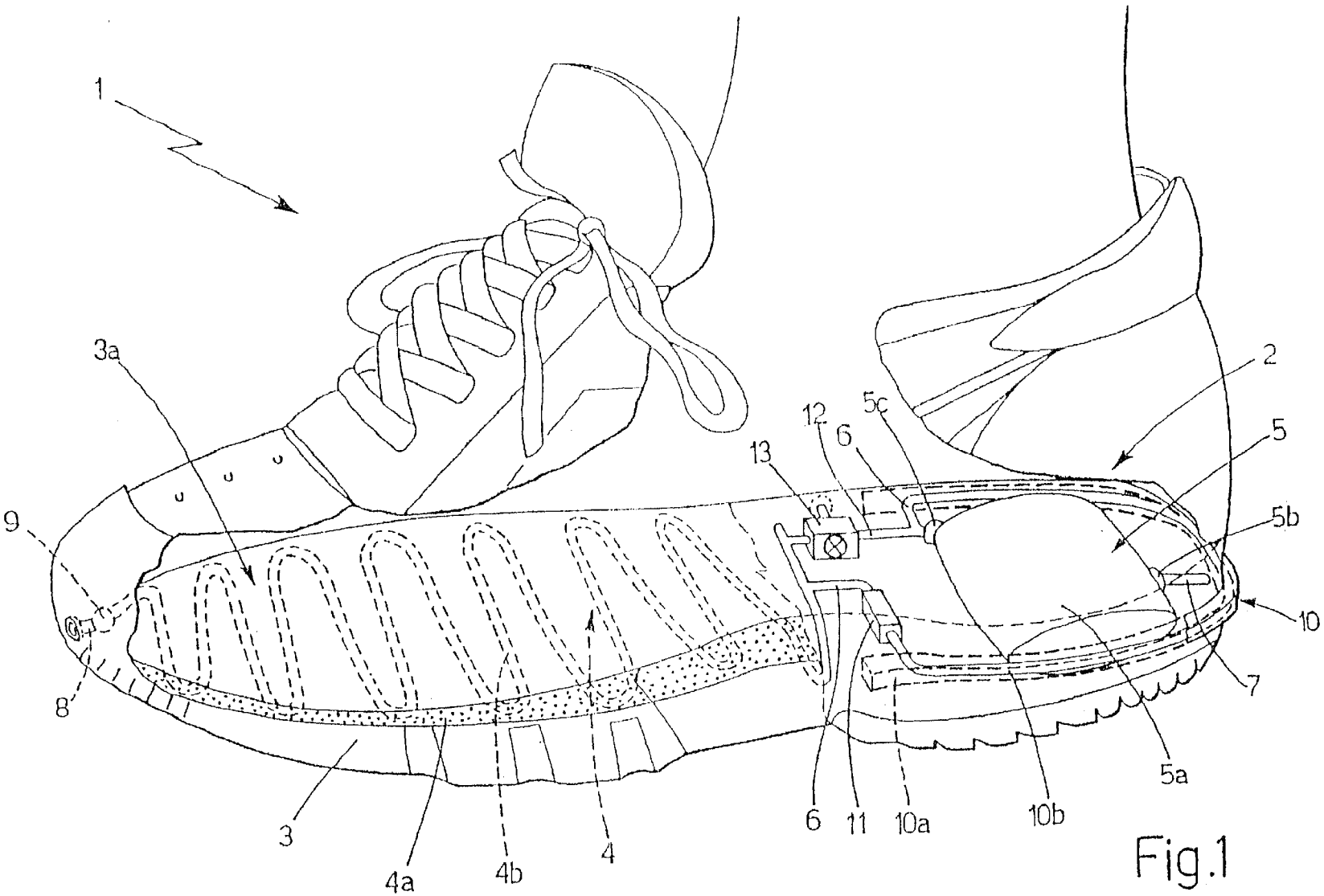
FIG. 1 shows a side view, with parts in section and parts removed for clarity, of a shoe in accordance with the teachings of the present invention.

Number 1 in FIG. 1 indicates as a whole a shoe having an active air-conditioning device 2 for so regulating the temperature inside shoe 1 as to provide for improved comfort of the foot inside shoe 1. More specifically, depending on the requirements of the user, air-conditioning device 2 provides for withdrawing or yielding heat from or to the foot in shoe

1, so as to maintain the temperature inside shoe 1 at a comfortable value considerably above or below that of the outside environment, as required.

Air-conditioning device 2 is preferably, but not necessarily, built into the sole 3 of shoe 1, and comprises: a heat exchanger 4 housed inside sole 3 of shoe 1, close to the upper surface 3*a* on which the sole of the foot rests; an air compressing device 5 for emitting a stream of pressurized air (at a pressure of a few tens of bars); and a feed conduit 6 connecting the outlet of air compressing device 5 to heat exchanger 4.

Air-conditioning device 2 also comprises an intake conduit 7 connecting air compressing device 5 to the outside environment; an exhaust conduit 8 connecting heat exchanger 4 to the outside environment; and possibly a known nonreturn valve 9 located along exhaust conduit 8 to prevent air from flowing back to heat exchanger 4.

Figure 2:
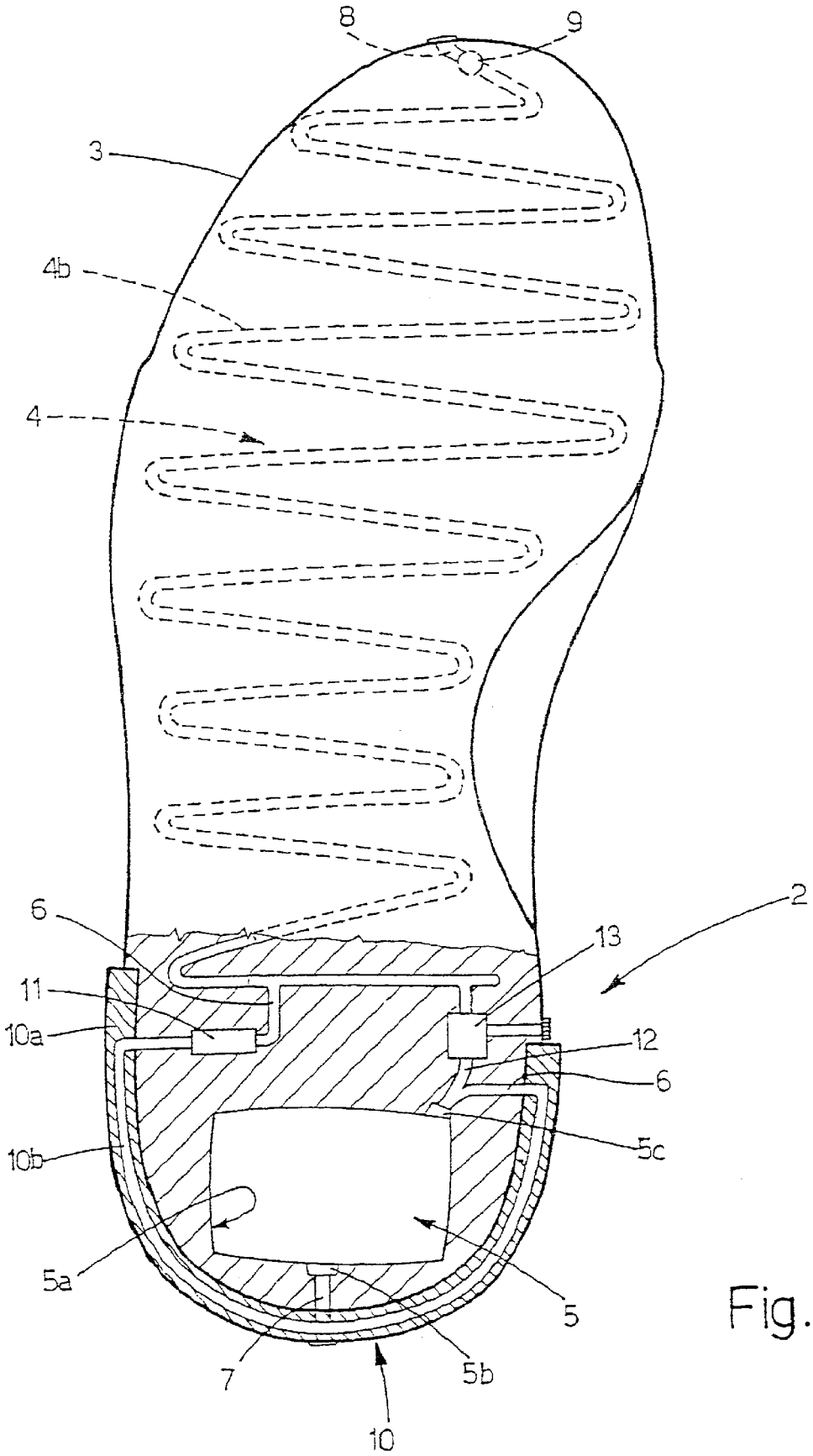
FIG. 2 shows a plan view, with parts in section and parts removed for clarity, of the sole of the FIG. 1 shoe.

With reference to FIGS. 1 and 2, in the example shown, heat exchanger 4 is defined by a layer 4*a* of good heat-conducting material, inside which is formed a coil 4*b* along which the pressurized air from air compressing device 5 flows. Layer 4*a* is preferably, but not necessarily, made of elastically deformable material, and is obviously built into sole 3 of shoe 1 so that coil 4*b* extends as close as possible to upper surface 3*a* of sole 3, to maximize heat exchange with the Foot inside shoe 1.

The rest of sole 3, on the other hand, is made of poor heat-conducting (i.e. thermally insulating) material so as to minimize heat exchange with the outside environment.

With reference to FIG. 1, air compressing device 5 is preferably, but not necessarily, located at the heel of sole 3, and is driven by the mechanical stress to which sole 3 is subjected as the user walks. More specifically, compressing device 5 is driven by the weight exerted cyclically on sole 3 of shoe 1 as the user walks.

It should be stressed that air compressing device 5 provides for substantially adiabatic compression of the outside air, and emits a stream of pressurized air at a higher temperature than that of the outside air.

In the example shown, air compressing device 5 comprises a lenticular, variable-volume chamber 5*a* formed in the heel—obviously made of elastically deformable material—of sole 3; an intake valve 5*b* located at the connection between chamber 5*a* and intake conduit 7; and a delivery valve 5*c* located at the connection between chamber 5*a* and feed conduit 6. Intake vale 5*b,* which is of known type, only permits airflow from intake conduit 7 to chamber 5*a* when the pressure inside chamber 5*a* is less than the outside pressure; whereas delivery valve 5*c,* which is also of known type, only permits airflow from chamber 5*a* to feed conduit 6 when the air pressure inside chamber 5*a* reaches a given value P (a few tens of bars).

Air compressing device 5 may, obviously, also be formed differently.

With reference to FIG. 1, air-conditioning device 2 also comprises, along feed conduit 6, a heat exchanger 10 for dissipating heat to the outside environment; and a laminating valve 11 for rapidly expanding and so sharply reducing the pressure of the air stream from heat exchanger 10.

Finally, air-conditioning device 2 also comprises a bypass conduit 12 connecting air compressing device 5 directly to heat exchanger 4 so as to bypass heat exchanger 10 and laminating valve 11; and an on-off valve 13 located along bypass conduit 12. On-off valve 13 is movable between an open position permitting pressurized airflow directly from air compressing device 5 to heat exchanger 4, and a closed position closing bypass conduit 12 in fluidtight manner, so that, to reach heat exchanger 4, the pressurized air stream is forced to flow along feed conduit 6 fitted with heat exchanger 10 and laminating valve 11.

With reference to FIGS. 1 and 2, in the example shown, heat exchanger 10 is defined by a member 10*a* made of good heat-conducting material, and in which is formed a conduit 10*b* along which the pressurized air stream from air compressing device 5 flows. Member 10*a* is fitted to the heel of sole 3, with part of the surface of the member facing the outside, so that the outside air flowing over said surface withdraws heat from the pressurized air stream flowing along conduit 10*b*.

Operation of air-conditioning device 2 will now be described, firstly assuming on-off valve 13 is open, and then assuming on-off valve 13 is closed.

As the user walks along with on-off valve 13 open, the pressurized air stream from air compressing device 5 flows along bypass conduit 12 directly to heat exchanger 4 where, before being exhausted to the outside along exhaust conduit 8, heat is yielded to and so heats the foot inside shoe 1, on account of the pressurized air stream from air compressing device 5, as stated, being at a far higher temperature than the outside air.

With on-off valve 13 open, air-conditioning device 2 therefore provides for maintaining the foot inside shoe 1 at a far higher temperature than the outside environment.

As the user walks along with on-off valve 13 closed, the pressurized air stream from air compressing device 5 flows along feed conduit 6 and successively through heat exchanger 10, where the temperature of the air stream is reduced by yielding heat to the outside, and through laminating valve 11 where rapid expansion produces a sharp fall in temperature.

The fall in temperature produced by rapid expansion (substantially adiabatic) reduces the pressurized air stream to a temperature lower than that inside shoe 1, so that, as it flows through heat exchanger 4, the pressurized air stream withdraws heat from and so cools the foot inside shoe 1.

With on-off valve 13 closed, air-conditioning device 2 therefore provides for maintaining the foot inside shoe 1 at a lower temperature than the outside environment.

The effect of air-conditioning device 2 may, obviously, be regulated accurately by choking the opening of on-off valve 13, so that the pressurized air stream can flow along both feed conduit 6 and bypass conduit 12.

Unlike currently marketed shoes, shoe 1 as described and illustrated herein has the major advantage of air-conditioning device 2 controlling the temperature inside shoe 1 and so greatly improving comfort of the foot. Moreover, the adjustments afforded by on-off valve 13 provide for regulating the local temperature inside shoe 1 according to individual users' requirements.

A further advantage lies in air-conditioning device 2 being integrated relatively cheaply inside sole 3.

Yet a further advantage lies in the fact that air compressing device 5, by absorbing part of the mechanical stress produced as the user walks along, considerably reduces the mechanical stress transmitted from the ground to the foot.

Clearly, changes may be made to shoe 1 as described and illustrated herein without, however, departing from the scope of the present invention.

In particular, according to a first variation not shown, air-conditioning device 2 may be designed solely to heat or cool the foot inside shoe 1.

In the example shown, in the first case, air-conditioning device 2 has no heat exchanger 10, no laminating valve 11, no bypass conduit 12, and no on-off valve 13, so that the pressurized air stream from air compressing device 5 flows directly to heat exchanger 4. In the second case, air-conditioning device 2 has no bypass conduit 12 and no on-off valve 13, so that the pressurized air stream from air compressing device 5 can only reach heat exchanger 4 by flowing through heat exchanger 10 and laminating valve 11.

According to a second variation not shown, heat exchanger 4 may also be built into the upper of shoe 1.

According to a third variation not shown, intake conduit 7 and exhaust conduit 8 are connected to each other to form a closed circuit. In which case, a gas other than air can be circulated inside air-conditioning device 2.

What is claimed is:

1. A shoe (1) having an active air-conditioning device (2) for selectively withdrawing or yielding heat from or to a foot inside the shoe (1), the active air-conditioning device (2) comprising:

at least one main heat exchanger (4) for exchanging heat with the inside of the shoe;

at least one air compressing device (5) for emitting a pressurized air stream; and at least one feed conduit (6) connecting said main heat exchanger (4) to an outlet of said air compressing device (5);

the shoe being characterized in that said air-conditioning device (2) also comprises an intake conduit (7) connecting said air compressing device (5) to the outside environment; and an exhaust conduit (8) connecting said main heat exchanger (4) to the outside environment.

2. A shoe as claimed in claim 1, characterized in that said active air-conditioning device (2) comprises, along said feed conduit (6), an auxiliary heat exchanger (10) for cooling the pressurized air stream circulating inside, and an expansion valve (11) for rapidly expanding and so sharply reducing pressure of the air stream from the auxiliary heat exchanger (10).

3. A shoe as claimed in claim 2, characterised in that said active air-conditioning device (2) comprises a bypass conduit (12) connecting the air compressing device (5) directly to the main heat exchanger (4) so as to bypass the auxiliary heat exchanger (10) and the expansion valve (11); and an on-off valve (13) located along the bypass conduit (12) to regulate passage of the pressurised air stream along the bypass conduit (12).

4. A shoe as claimed in claim 3, wherein said active air-conditioning device (2) further comprises a non-return valve (9) located along said exhaust conduit (8) to prevent air from flowing back to the main heat exchanger (4).

5. A shoe as claimed in claim 4, characterized in that said main heat exchanger (4), said air compressing device (5), and said feed conduit (6) are built into a sole (3) of the shoe (1).

6. A shoe as claimed in claim 5, characterized in that said main heat exchanger (4) is defined by a layer (4*a*) of good heat-conducting material, in which is formed a coil (4*b*) along which the pressurized air stream from said air compressing device (5) flows; said layer (4*a*) being integrated into the sole (3) of the shoe (1) so that said coil (4*b*) extends close to the upper surface (3*a*) of the sole (3).

7. A shoe as claimed in claim 1, characterized in that said main heat exchanger (4), said air compressing device (5), and said feed conduit (6) are built into a sole (3) of the shoe (1).

8. A shoe as claimed in claim 7, characterized in that said main heat exchanger (4) is defined by a layer **(4*a*) of good heat-conducting material, in which is formed a coil (4*b*) along which the pressurised air stream from said air compressing device (5) flows; said layer (4*a*) being integrated in the sole (3) of the shoe (1) so that said coil (4*b*) extends close to the upper surface (3*a*) of the sole (3)**.

9. An active air-conditioning device for a shoe, comprising:

at least one main heat exchanger for exchanging heat with the inside of a shoe;

at least one air compressing device for emitting a pressurized air stream;

at least one feed conduit connecting said main heat exchanger to an outlet of said air compressing device;

an intake conduit connecting said air compressing device to the outside environment; and an exhaust conduit connecting said main heat exchanger to the outside environment, wherein said main heat exchanger (4), said air compressing device (5), and said feed conduit (6) are built into a sole (3) of the shoe.

10. An active air-conditioning device as claimed in claim 9, wherein said main heat exchanger (4) is defined by a layer **(4*a*) of good heat-conducting material, in which is formed a coil (4*b*) to pass the pressurized air stream from an expansion valve (11); said layer (4*a*) being integrated into a sole (3) of the shoe (1) so that said coil (4*b*) extends close to the upper surface (3*a*) of the sole (3)**.

11. An active air-conditioning device according to claim 10, further comprising at least one auxiliary heat exchanger (10) interposed between air compressing device (5) and said main heat exchanger (4) to cool the pressurized air stream from the air compressing device (5), and at least one expansion valve (11) for rapidly expanding to reduce the temperature of the air stream.

12. An active air-conditioning device as claimed in claim 9, further comprising a bypass conduit (12) connecting the air compressing device directly to the main heat exchanger so as to bypass the auxiliary heat exchanger (10) and a laminating valve (11) and an on-off valve (13) located along the bypass conduit (12) to regulate passage of the pressurized air stream along the bypass conduit (12).

13. An active air-conditioning device as claimed in claim 12, wherein the device further comprises a non-return valve (9) located along an exhaust conduit (8) to prevent air from flowing back to the main heat exchanger (4).

14. An active device for reducing mechanical stress from the ground during a walk and maintaining a temperature inside a shoe, comprising:

at least one main heat exchanger (4) for exchanging heat with the inside of a shoe;

at least one air compressing device (5) for absorbing a part of mechanical stress from a user's weight on the ground and for emitting a pressurized air stream;

at least one feed conduit (6) connecting said main heat exchanger (4) to an outlet of said air compressing device (5);

at least one auxiliary heat exchanger (10) interposed between air compressing device (5) and said main heat exchanger (4) to cool the pressurized air stream from the air compressing device (5);

at least one laminating valve (11) for reducing temperature of the air stream by fast expansion;

a bypass conduit (12) connecting the air compressing device directly to the main heat exchanger so as to bypass the auxiliary heat exchanger (10) and the laminating valve (11);

an on-off valve (13) located along the bypass conduit (12) to regulate passage of the pressurized air stream along the bypass conduit (12);

an intake conduit (7) connecting said air compressing device (5) to the outside environment; and an exhaust conduit (8) connecting said main heat exchanger (4) to the outside environment.

15. An active air-conditioning device as claimed in claim 14, wherein said main heat exchanger (4), said air compressing device (5), and said feed conduit (6) are built into a sole (3) of a shoe.

16. An active air-conditioning device as claimed in claim 15, wherein said main heat exchanger (4) is defined by a layer **(4*a*) of good heat-conducting material, in which is formed a coil (4*b*) to pass the pressurized air stream from said laminating valve (11), said layer (4*a*) being integrated into a sole (3) of a shoe, said sole having an upper surface (3*a*), so that said coil (4*b*) extends close to the upper surface (3*a*) of the sole (3)**.

17. An active air-conditioning device as claimed in claim 16, further comprising a non-return valve (9) located along said exhaust conduit (8) to prevent air from flowing back to the main heat exchanger (4).

* * * * *